US011339800B2

(12) United States Patent
Sakota et al.

(10) Patent No.: US 11,339,800 B2
(45) Date of Patent: May 24, 2022

(54) CENTRIFUGAL COMPRESSOR WITH HEAT EXCHANGER

(71) Applicant: IHI Corporation, Tokyo (JP)

(72) Inventors: Koji Sakota, Tokyo (JP); Nobuyuki Ikeya, Tokyo (JP); Kaoru Kaneko, Tokyo (JP)

( * ) Notice: Subject to any disclaimer, the term of this patent is extended or adjusted under 35 U.S.C. 154(b) by 140 days.

(21) Appl. No.: 16/862,565

(22) Filed: Apr. 30, 2020

(65) Prior Publication Data

US 2020/0256343 A1 Aug. 13, 2020

Related U.S. Application Data

(63) Continuation of application No. PCT/JP2018/039371, filed on Oct. 23, 2018.

(30) Foreign Application Priority Data

Nov. 1, 2017 (JP) ..... JP2017-211843

(51) Int. Cl.

| | |
|---|---|
| ***F04D 29/58*** | (2006.01) |
| ***F01D 17/14*** | (2006.01) |
| ***F04D 17/10*** | (2006.01) |
| ***F04D 25/08*** | (2006.01) |

(Continued)

(52) U.S. Cl.

CPC ..... *F04D 29/5826* (2013.01); *F01D 17/141* (2013.01); *F04D 17/10* (2013.01); *F04D 25/08* (2013.01); *F04D 25/082* (2013.01); *F04D 29/056* (2013.01); *F04D 29/42* (2013.01);

(Continued)

(58) Field of Classification Search

None

See application file for complete search history.

(56) References Cited

U.S. PATENT DOCUMENTS

| | | | |
|---|---|---|---|
| 4,125,345 | A | 11/1978 | Toshinaga et al. |
| 5,250,863 | A | 10/1993 | Brandt |
| 6,102,672 | A | 8/2000 | Woollenweber et al. |

(Continued)

FOREIGN PATENT DOCUMENTS

| | | |
|---|---|---|
| CN | 2916210 | 6/2007 |
| CN | 101793257 | 8/2010 |

(Continued)

OTHER PUBLICATIONS

SOEI Patent and Law Firm, Statement of Related Matters, dated Jul. 10, 2020.

(Continued)

*Primary Examiner* — Juan G Flores

(74) *Attorney, Agent, or Firm* — Soei Patent & Law Firm

(57) ABSTRACT

A centrifugal compressor includes a rotary shaft of a compressor impeller, a gas bearing structure that supports the rotary shaft, a motor that rotates the rotary shaft, a motor housing that houses the motor, a compressor housing that houses the compressor impeller and includes an intake port and a discharge port, a gas bleed port that is provided closer to the discharge port than the compressor impeller in a flow direction in the compressor housing, a bearing cooling line that connects the gas bleed port to the gas bearing structure, and a heat exchanger that is disposed on the bearing cooling line. The heat exchanger is mounted on at least one of the motor housing and the compressor housing.

20 Claims, 5 Drawing Sheets

(51) Int. Cl.
*F04D 29/056* (2006.01)
*F04D 29/42* (2006.01)

(52) U.S. Cl.
CPC ..... *F04D 29/4206* (2013.01); *F05D 2220/30* (2013.01); *F05D 2250/52* (2013.01)

(56) References Cited

U.S. PATENT DOCUMENTS

| | | | | |
|---|---|---|---|---|
| 8,523,540 | B2 | 9/2013 | Eide et al. | |
| 9,863,430 | B2 * | 1/2018 | Lee | F04D 25/082 |
| 10,808,723 | B2 * | 10/2020 | Nagao | F04D 29/048 |
| 11,143,204 | B2 * | 10/2021 | Park | F04D 29/0513 |
| 2008/0141679 | A1 | 6/2008 | Behaghel et al. | |
| 2009/0028730 | A1 | 1/2009 | Radermacher et al. | |
| 2009/0056681 | A1 | 3/2009 | Shibui et al. | |
| 2011/0097222 | A1 | 4/2011 | Komatsu et al. | |
| 2011/0150637 | A1 | 6/2011 | Radermacher et al. | |
| 2011/0239694 | A1 | 10/2011 | Sugitani et al. | |
| 2014/0144412 | A1 | 5/2014 | An et al. | |
| 2015/0308456 | A1 | 10/2015 | Thompson et al. | |
| 2016/0032931 | A1 | 2/2016 | Lee | |
| 2016/0102677 | A1 | 4/2016 | An et al. | |
| 2017/0211595 | A1 | 7/2017 | Bertoneri et al. | |
| 2017/0328269 | A1 | 11/2017 | Yamashita et al. | |

FOREIGN PATENT DOCUMENTS

| | | |
|---|---|---|
| CN | 201934335 | 8/2011 |
| CN | 102213221 | 10/2011 |
| CN | 103174678 | 6/2013 |
| CN | 104653478 | 5/2015 |
| CN | 106104006 | 11/2016 |
| CN | 106460863 | 2/2017 |
| CN | 206268135 | 6/2017 |
| DE | 4222394 | 12/1993 |
| EP | 2314878 | 11/2016 |
| EP | 3128184 | 2/2017 |
| JP | S63-277821 | 11/1988 |
| JP | H3-015696 | 1/1991 |
| JP | H4-099418 | 8/1992 |
| JP | H5-033667 | 2/1993 |
| JP | 2001-200791 | 7/2001 |
| JP | 2007-040255 | 2/2007 |
| JP | 2008-025577 | 2/2008 |
| JP | 2009-097519 | 5/2009 |
| JP | 2010-151034 | 7/2010 |
| JP | 2010-196478 | 9/2010 |
| JP | 2011-089459 | 5/2011 |
| JP | 2011-089549 | 5/2011 |
| JP | 2011-202588 | 10/2011 |
| JP | 2011-202589 | 10/2011 |
| JP | 2012-062778 | 3/2012 |
| JP | 2012-246931 | 12/2012 |
| JP | 2013-024041 | 2/2013 |
| JP | 2014-058935 | 4/2014 |
| SE | 467752 | 9/1992 |
| WO | 2013/187786 | 12/2013 |

OTHER PUBLICATIONS

International Search Report dated Jan. 22, 2019 for PCT/JP2018/039371.
International Search Report dated Jan. 22, 2019 for PCT/JP2018/039913.
International Search Report dated Jan. 22, 2019 for PCT/JP2018/039363.
International Preliminary Report on Patentability with Written Opinion dated May 14, 2020 for PCT/JP2018/039363.
International Preliminary Report on Patentability with Written Opinion dated May 14, 2020 for PCT/JP2018/039371.

* cited by examiner

CENTRIFUGAL COMPRESSOR WITH HEAT EXCHANGER

CROSS-REFERENCE TO RELATED APPLICATIONS

This application is a continuation application of PCT Application No. PCT/JP2018/039371, filed Oct. 23, 2018, which claims the benefit of priority from Japanese Patent Application No. 2017-211843, filed Nov. 1, 2017, the entire contents of which are incorporated herein by reference.

BACKGROUND

Japanese Unexamined Patent Publication No. 2013-24041 and Japanese Unexamined Patent Publication No. 2012-62778) describe a centrifugal compressor, such as an electric supercharger, where cooling oil is circulated to cool a motor. Further, Japanese Unexamined Utility Model Publication No. H4-99418 and Japanese Unexamined Patent Publication No. H5-33667) describe a centrifugal compressor that supports a rotary shaft of a compressor impeller, where air compressed by the compressor impeller is used as pressurized air in the centrifugal compressor.

SUMMARY

An example centrifugal compressor disclosed herein includes a rotary shaft of a compressor impeller, a gas bearing structure that supports the rotary shaft, a motor that rotates the rotary shaft, a motor housing that houses the motor, and a compressor housing that houses the compressor impeller and includes an intake port and a discharge port. Additionally, the centrifugal compressor includes a gas bleed port that is provided closer to the discharge port than the compressor impeller in a flow direction in the compressor housing, a bearing cooling line that connects the gas bleed port to the gas bearing structure, and a heat exchanger that is disposed on the bearing cooling line. The heat exchanger is mounted on at least one of the motor housing and the compressor housing.

Another example centrifugal compressor disclosed herein includes a rotary shaft of a compressor impeller, a gas bearing structure that supports the rotary shaft, a motor that rotates the rotary shaft, a motor housing that houses the motor, and a compressor housing that houses the compressor impeller. Additionally, the centrifugal compressor includes a bearing cooling line that supplies a part of compressed gas compressed by the compressor impeller to the gas bearing structure, and a heat exchanger that is disposed on the bearing cooling line. The heat exchanger is mounted on at least one of the motor housing and the compressor housing.

DETAILED DESCRIPTION

Figure 1:
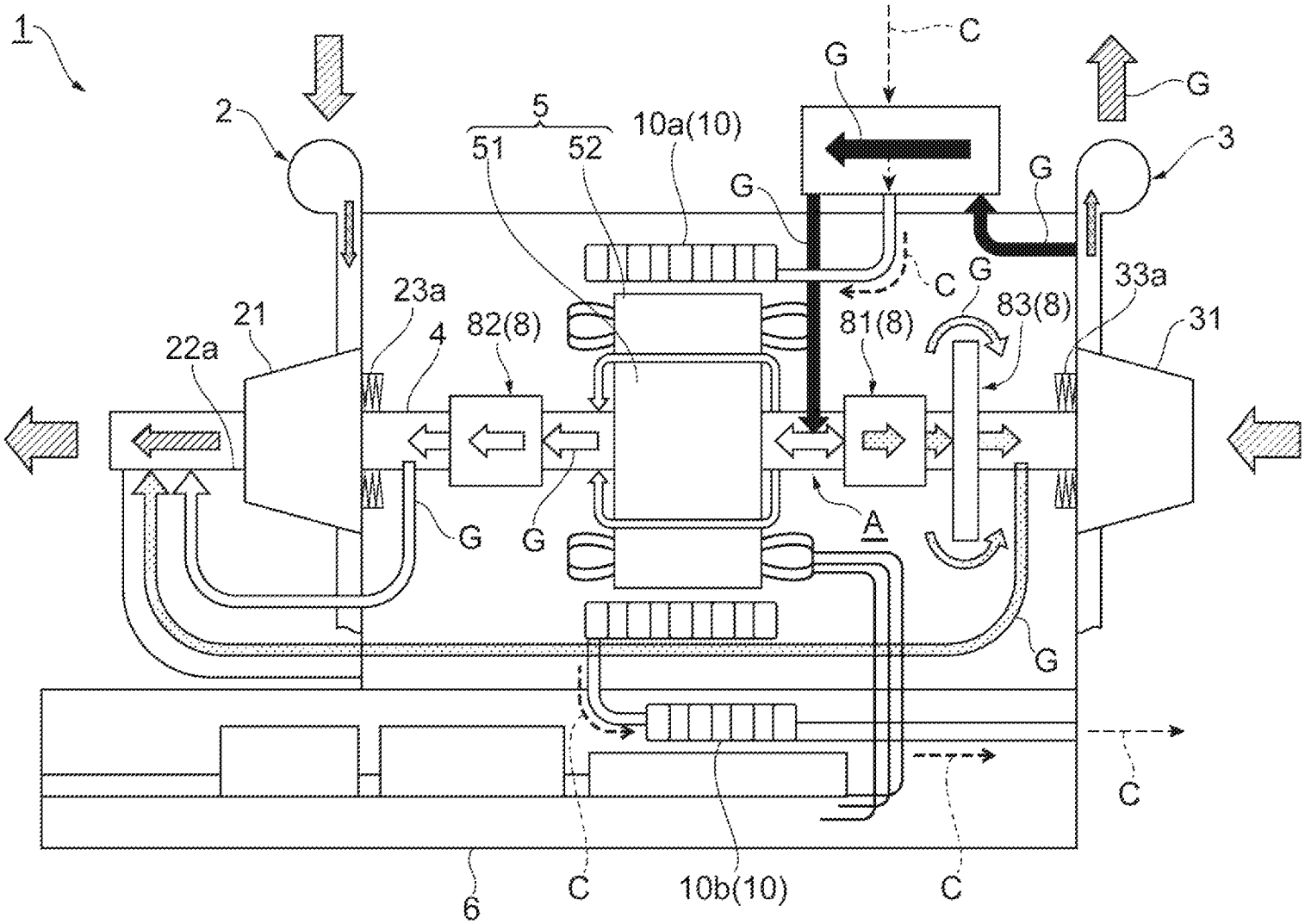
FIG. 1 is a diagram schematically illustrating an example centrifugal compressor.

An example centrifugal compressor may include a rotary shaft of a compressor impeller, a gas bearing structure that supports the rotary shaft, a motor that rotates the rotary shaft, a motor housing that houses the motor, a compressor housing that houses the compressor impeller and includes an intake port and a discharge port, a gas bleed port that is provided closer to the discharge port than the compressor impeller in a flow direction in the compressor housing, a bearing cooling line that connects the gas bleed port to the gas bearing structure, and a heat exchanger that is disposed on the bearing cooling line. Additionally, the heat exchanger may be mounted on at least one of the motor housing and the compressor housing.

In some examples, a part of compressed gas compressed by the compressor impeller passes through the gas bleed port and is supplied to the bearing cooling line. The heat exchanger is disposed on the bearing cooling line, and the compressed gas cooled by the heat exchanger is supplied to the gas bearing structure and cools the gas bearing structure. In some examples, the compressed gas is used as a refrigerant that independently cools the gas bearing structure. The heat exchanger, which cools the compressed gas, is mounted on at least one of the motor housing and the compressor housing. By reducing the length of a cooling path when the compressed gas cooled by the heat exchanger is supplied to the gas bearing structure, as compared to a case where the heat exchanger is installed at another place outside the centrifugal compressor, a heat loss can be suppressed while maintaining compatibility of the compressed gas with the gas bearing structure. Additionally, by using the compressed gas to cool the gas bearing structure using a compact internal structure, the size of the centrifugal compressor may be reduced.

In some examples, the heat exchanger may include a gas flow passage through which compressed gas passes through the bearing cooling line, and a refrigerant flow passage through which a refrigerant of which the temperature is lower than the temperature of the compressed gas passes. Additionally, the gas flow passage may include an inlet and an outlet for the compressed gas, and the inlet may be disposed closer to the compressor impeller than the outlet in a direction along the rotary shaft. By locating the inlet of the gas flow passage closer to the compressor impeller, a cooling path along which the compressed gas is introduced into the heat exchanger can be made shorter in order to reduce the overall size of the centrifugal compressor.

In some examples, the gas bearing structure may include a thrust bearing and a radial bearing, and the bearing cooling line may include a first cooling path that passes through at least the thrust bearing and a second cooling path that passes through the radial bearing without passing through the thrust bearing. The first cooling path for cooling the thrust bearing may be separated from the second cooling path for cooling the radial bearing in order to efficiently cool the thrust bearing and the radial bearing.

In some examples, the bearing cooling line may include an upstream side relative to the gas bearing structure, a downstream side relative to the gas bearing structure, and a flow rate adjusting unit that is provided to at least one of the upstream side and the downstream side. Additionally, the flow rate adjusting unit makes the flow passage cross-section of the second cooling path smaller than the flow passage cross-section of the first cooling path. In the flow rate adjusting unit, the flow passage cross-section of the first cooling path is made larger than the flow passage cross-section of the second cooling path. When the flow rate of the compressed gas, which is cooled by the heat exchanger, passing along the first cooling path is higher than the flow rate of the compressed gas passing along the second cooling path, the thrust bearing may be more efficiently or selectively cooled.

In some examples, the flow rate adjusting unit may include a first orifice that is disposed on the downstream side relative to the gas bearing structure on the first cooling path and a second orifice that is disposed on the downstream side relative to the gas bearing structure on the second cooling path. Additionally, the orifice diameter of the first orifice may be larger than the orifice diameter of the second orifice. Accordingly, the flow rate of the compressed gas passing along the first cooling path may be made higher than the flow rate of the compressed gas passing along the second cooling path in order to more efficiently or selectively cool the thrust bearing.

An example centrifugal compressor may include a rotary shaft of a compressor impeller, a gas bearing structure that supports the rotary shaft, a motor that rotates the rotary shaft, a motor housing that houses the motor, and a compressor housing that houses the compressor impeller. Additionally, the centrifugal compressor may include a bearing cooling line that supplies a part of compressed gas compressed by the compressor impeller to the gas bearing structure, and a heat exchanger that is disposed on the bearing cooling line. In some examples, the heat exchanger is mounted on at least one of the motor housing and the compressor housing.

Hereinafter, with reference to the drawings, the same elements or similar elements having the same function are denoted by the same reference numerals, and redundant description will be omitted.

An example centrifugal compressor 1 is illustrated in FIG. 1. In some examples, the centrifugal compressor 1 may comprise an electric supercharger. The centrifugal compressor 1 may be configured for use with, for example, a fuel cell system E (see FIG. 5). The fuel cell system may be, for example, a polymer electrolyte fuel cell (PEFC), a phosphoric acid fuel cell (PAFC), or the like.

Figure 2:
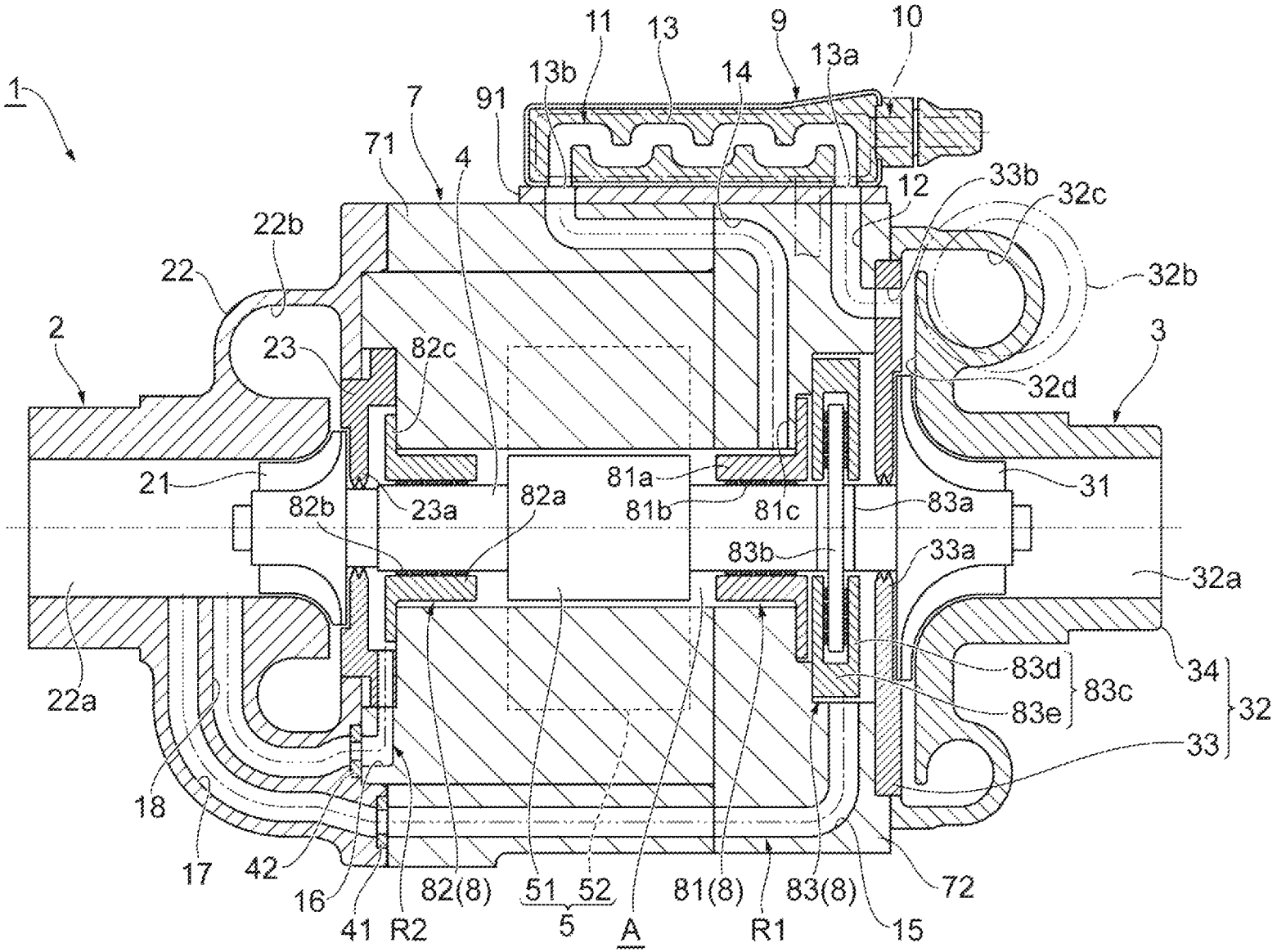
FIG. 2 is a cross-sectional view of the example centrifugal compressor of FIG. 1.

As illustrated in FIGS. 1 and 2, the centrifugal compressor 1 includes a turbine 2, a compressor 3, and a rotary shaft 4 of which both ends are provided with the turbine 2 and the compressor 3. An electric motor 5 for applying drive torque to the rotary shaft 4 is installed between the turbine 2 and the compressor 3. Compressed air (or other types of "compressed gas") G, which is compressed by the compressor 3, is supplied to the fuel cell system E as an oxidant (oxygen). Electricity is generated in the fuel cell system E by a chemical reaction between fuel and the oxidant. Air containing water vapor is discharged from the fuel cell system E, and is supplied to the turbine 2.

The centrifugal compressor 1 rotates a turbine impeller 21 of the turbine 2 using high-temperature air discharged from the fuel cell system E. When the turbine impeller 21 is rotated, a compressor impeller 31 of the compressor 3 is rotated and the compressed air G is supplied to the fuel cell system E. Additionally, in the centrifugal compressor 1, most of the drive force of the compressor 3 may be applied by the motor 5. Accordingly, the centrifugal compressor 1 may be configured as an electric supercharger that is substantially driven by an electric motor.

The fuel cell system E and the centrifugal compressor 1 may be mounted on, for example, a vehicle (electric automobile). Meanwhile, electricity generated in the fuel cell system E may be supplied to the motor 5 of the centrifugal compressor 1, but electricity may be supplied to the motor 5 from systems other than the fuel cell system E.

The centrifugal compressor 1 includes the turbine 2, the compressor 3, the rotary shaft 4, the motor 5, and an inverter 6 that controls the rotational drive of the motor 5.

The turbine 2 includes a turbine housing 22 and a turbine impeller 21 housed in the turbine housing 22. The compressor 3 includes a compressor housing 32 and a compressor impeller 31 housed in the compressor housing 32. The turbine impeller 21 is provided at one end (e.g., a first end) of the rotary shaft 4, and the compressor impeller 31 is provided at the other end (e.g., a second end) of the rotary shaft 4.

A motor housing 7 is provided between the turbine housing 22 and the compressor housing 32. The rotary shaft 4 is rotatably supported via an air bearing structure (or other type of "gas bearing structure") 8 by the motor housing 7.

The turbine housing 22 is provided with an exhaust gas inlet and an exhaust gas outlet 22*a*. Air, which contains water vapor and is discharged from the fuel cell system E, flows into the turbine housing 22 through the exhaust gas inlet. The air flowing in passes through a turbine scroll flow passage 22*b* and is supplied to the inlet side of the turbine impeller 21. The turbine impeller 21 (for example, a radial turbine) generates torque using the pressure of the supplied air. After that, the air flows out of the turbine housing 22 through the exhaust gas outlet 22*a*.

The compressor housing 32 is provided with an intake port or air intake port 32*a* and a discharge port 32*b*. When the turbine impeller 21 is rotated as described above, the rotary shaft 4 and the compressor impeller 31 are rotated. The compressor impeller 31, which is being rotated, takes in outside air through the intake port 32*a* and compresses the outside air. The compressed air G compressed by the compressor impeller 31 passes through a compressor scroll flow passage 32*c* and is discharged from the discharge port 32*b*. The compressed air G discharged from the discharge port 32*b* is supplied to the fuel cell system E.

The motor 5 (for example, a brushless AC motor) includes a rotor 51 as a rotating element and a stator 52 as a stationary element. The rotor 51 includes one or more magnets. The rotor 51 is fixed to the rotary shaft 4, and can be rotated about an axis together with the rotary shaft 4. The rotor 51 is disposed at the middle portion of the rotary shaft 4 in the direction of the axis of the rotary shaft 4. The stator 52 includes a plurality of coils and an iron core. The stator 52 surrounds the rotor 51 in the circumferential direction of the rotary shaft 4. The stator 52 generates a magnetic field around the rotary shaft 4, and rotates the rotary shaft 4 in cooperation with the rotor 51.

An example cooling structure includes a heat exchanger 9 that is mounted on the motor housing 7, a refrigerant line (or "refrigerant flow passage") 10 that includes a flow passage passing through the heat exchanger 9, and an air-cooling line (or "bearing cooling line") 11. The refrigerant line 10 and the air-cooling line 11 are connected or fluidly coupled to each other so that heat can be exchanged in the heat exchanger 9. A part of the compressed air G compressed by the compressor 3 passes through the air-cooling line 11. Additionally, a coolant C (or "refrigerant") of which the temperature is lower than the temperature of the compressed air G passing through the air-cooling line 11, passes through the refrigerant line 10.

The refrigerant line 10 is a part of a circulation line that is connected or fluidly coupled to a radiator provided outside the centrifugal compressor 1. The temperature of the coolant C passing through the refrigerant line 10 is in the range of 50° C. to 100° C. The refrigerant line 10 includes a motor cooling portion 10*a* that is disposed along the stator 52 and an inverter cooling portion 10*b* that is disposed along the inverter 6. A coolant C having passed through the heat exchanger 9 flows through the motor cooling portion 10*a* while going around the stator 52, and cools the stator 52. After that, the coolant C flows through the inverter cooling portion 10*b* while meandering along a control circuit of the inverter 6, for example, an insulated gate bipolar transistor (IGBT), a bipolar transistor, a MOSFET, a GTO, or the like, and cools the inverter 6.

The air-cooling line 11 extracts and transfers a part of the compressed air G compressed by the compressor 3. The centrifugal compressor 1 is configured so that pressure on the side of the compressor 3 is higher than pressure on the side of the turbine 2. The air-cooling line 11 has a structure that cools the air bearing structure 8 by using a difference between the pressure on the side of the compressor 3 and the pressure on the side of the turbine 2. That is, the air-cooling line 11 extracts a part of the compressed air G compressed by the compressor 3, guides the compressed air G to the air bearing structure 8, and sends the compressed air G having passed through the air bearing structure 8 to the turbine 2. Additionally, the temperature of the compressed air G that is in the range of 150° C. to 250° C., is made to fall to the range of about 70° C. to 110° C. by the heat exchanger 9, and in some examples is made to fall to the range of about 70° C. to 80° C. By maintaining the temperature of the air bearing structure 8 at 150° C. or more, the air bearing structure 8 can be suitably cooled by the supply of the compressed air G. The air-cooling line 11 will be described in additional detail below.

The motor housing 7 includes a stator housing 71 that houses the stator 52 surrounding the rotor 51, and a bearing housing 72 that is provided with the air bearing structure 8. A shaft space A where the rotary shaft 4 penetrates is formed in the stator housing 71 and the bearing housing 72. Labyrinth structures 33*a* and 23*a* for making the inside of the shaft space A be kept airtight are provided at both end portions Aa, Ab of the shaft space A.

The compressor housing 32 is fixed to the bearing housing 72. The compressor housing 32 includes an impeller chamber 34 that houses the compressor impeller 31, and a diffuser plate 33 that forms a diffuser flow passage 32*d* in cooperation with the impeller chamber 34. The impeller chamber 34 includes an intake port 32*a* that takes in air, a discharge port 32*b* that discharges the compressed air G compressed by the compressor impeller 31, and a compressor scroll flow passage 32*c* that is provided to the downstream side of the diffuser flow passage 32*d* in the flow direction of the compressed air G.

The diffuser plate 33 is provided with the labyrinth structure 33*a*. Further, a gas bleed port 33*b* through which a part of the compressed air G passes is formed in the diffuser plate 33. The gas bleed port 33*b* is provided closer to the discharge port 32*b*, that is, the downstream side relative to the compressor impeller 31 in the flow direction in the compressor housing 32, and is an inlet of the air-cooling line 11. The gas bleed port 33*b* is connected or fluidly coupled to a first communication flow passage 12 provided in the bearing housing 72. The first communication flow passage 12 is connected or fluidly coupled to the heat exchanger 9. The heat exchanger 9 is mounted on the outer peripheral surface of the motor housing 7 via a pedestal 91. A communication hole, which allows an inlet of the heat exchanger 9 and the first communication flow passage 12 to communicate with each other, is formed in the pedestal 91. Additionally, the heat exchanger 9 is illustrated as being mounted on the motor housing 7, but in some examples at least a part of the heat exchanger 9 may be mounted on the compressor housing 32.

An air flow passage (or "gas flow passage") 13 through which the compressed air G passes is formed in the heat exchanger 9. The air flow passage 13 is a part of the air-cooling line 11, and may be configured to exchange heat with the refrigerant line 10. The heat exchanger 9 is installed on, or extends across both the stator housing 71 and the bearing housing 72. An upstream inlet 13*a* of the air flow passage 13 is provided close to the bearing housing 72, and a downstream outlet 13*b* thereof is provided close to the stator housing 71. For example, the inlet 13*a* of the air flow passage 13 is disposed closer to the compressor impeller 31 than the downstream outlet 13*b* in a direction along the rotary shaft 4. Additionally, the inlet 13*a* may be closer to the compressor impeller 31 than the outlet 13*b* when a distance in the direction along the axis of the rotary shaft 4 is considered.

The outlet 13*b* of the air flow passage 13 is connected or fluidly coupled to a second communication flow passage 14 through a communication port provided in the pedestal 91. The motor housing 7 is provided with the second communication flow passage 14. The second communication flow passage 14 passes through the stator housing 71 and the bearing housing 72, and is connected or fluidly coupled to the air bearing structure 8 disposed in the shaft space A.

The example air bearing structure 8 is now described in additional detail. The air bearing structure 8 includes a pair of radial bearings 81 and 82 and a thrust bearing 83.

The pair of radial bearings 81 and 82 restricts the movement of the rotary shaft 4 in a direction orthogonal to the rotary shaft 4 while allowing the rotation of the rotary shaft 4. The pair of radial bearings 81 and 82 may comprise dynamic pressure air bearings which are disposed with the rotor 51, so that the rotor 51 is provided at the middle portion of the rotary shaft 4 and is interposed between the pair of radial bearings 81 and 82.

The pair of radial bearings 81 and 82 includes a first radial bearing 81 disposed between the rotor 51 and the compressor impeller 31, and a second radial bearing 82 disposed between the rotor 51 and the turbine impeller 21. In some examples the first radial bearing 81 and the second radial bearing 82 have substantially the same structure, and so the first radial bearing 81 will be described as representative of the pair of radial bearings 81 and 82. Additionally, one or more examples may refer to the first and second radial bearings in a reverse order, in which case radial bearing 82 may be referred to as the first radial bearing, and radial bearing 81 may be referred to as the second radial bearing, according to the order in which they are referred to.

The first radial bearing 81 has a structure that introduces ambient air into a space between the rotary shaft 4 and the first radial bearing 81 (wedge effect) as a result of the rotation of the rotary shaft 4, increases pressure, and obtains a load capacity. The first radial bearing 81 supports the rotary shaft 4 by the load capacity obtained from the wedge effect while allowing the rotary shaft 4 to be rotatable.

The first radial bearing 81 includes, for example, a cylindrical bearing body 81*a* that surrounds the rotary shaft 4, and an air introducing portion 81*b* that is provided between the bearing body 81*a* and the rotary shaft 4 and generates the wedge effect by the rotation of the rotary shaft 4. The bearing body 81*a* is fixed to the bearing housing 72 via a flange 81*c*. For example, a foil bearing, a tilting pad bearing, a spiral groove bearing, and the like can be used as the first radial bearing 81. In some examples, the air introducing portion 81*b* may include a flexible foil, a tapered portion or a spiral groove provided on the inner surface of the bearing body 81*a*.

In some examples, a first air-cooling gap Sa comprising an air layer is formed between the bearing body 81*a* and the rotary shaft 4 by the wedge effect and the compressed air G passes through this gap. This first air-cooling gap forms a part of the air-cooling line 11. Likewise, the second radial bearing 82 includes a bearing body 82*a*, an air introducing portion 82*b*, and a flange 82*c*, and a second air-cooling gap Sb formed between the bearing body 82*a* and the rotary shaft 4 by the wedge effect forms a part of the air-cooling line 11.

The thrust bearing 83 restricts the movement of the rotary shaft 4 in the direction of the axis of the rotary shaft 4 while allowing the rotation of the rotary shaft 4. The thrust bearing 83 may comprise a dynamic pressure air bearing that is disposed between the first radial bearing 81 and the compressor impeller 31.

The thrust bearing 83 has a structure that introduces ambient air into a space between the rotary shaft 4 and the thrust bearing 83 (wedge effect) as a result of the rotation of the rotary shaft 4, increases pressure, and obtains load capacity. The thrust bearing 83 supports the rotary shaft 4 by the load capacity obtained from the wedge effect while allowing the rotary shaft 4 to be rotatable.

The thrust bearing 83 includes, for example, an annular thrust collar 83*a* that is fixed to the rotary shaft 4 and an annular bearing body 83*c* that is fixed to the bearing housing 72. The thrust collar 83*a* includes a disc-shaped collar pad 83*b* that is provided along a plane orthogonal to the axis of the rotary shaft 4. The bearing body 83*c* includes a pair of bearing pads 83*d* that is provided on both surfaces of the collar pad 83*b* to face each other and an annular spacer 83*e* that holds the pair of bearing pads 83*d* with a predetermined interval between the bearing pads 83*d*. The spacer 83*e* is disposed along the outer peripheral end of the collar pad 83*b*, and a third air-cooling gap Sc through which the compressed air G can pass is formed between the spacer 83*e* and the collar pad 83*b*.

The collar pad 83*b* and the bearing pad 83*d* form an air introducing portion for generating a wedge effect in cooperation with each other. For example, the air introducing portion of the thrust bearing 83 may be formed from a flexible foil provided between the collar pad 83*b* and the bearing pad 83*d*, or from a tapered portion or a groove provided on the collar pad 83*b*. In some examples, a foil bearing, a tilting pad bearing, a spiral groove bearing, and the like can be used as the thrust bearing 83.

In some examples, a fourth air-cooling gap Sd comprising an air layer is formed between the collar pad 83*b* and the bearing pad 83*d* by the wedge effect. Further, the third air-cooling gap Sc through which the compressed air G can pass is formed even between the spacer 83*e* and the collar pad 83*b*. The fourth air-cooling gap Sd formed between the collar pad 83*b* and the bearing pad 83*d* and the third air-cooling gap Sc formed between the spacer 83*e* and the collar pad 83*b* form a part of the air-cooling line 11 through which the compressed air G passes.

The second communication flow passage 14 is connected or fluidly coupled to the first radial bearing 81. For example, a first outer gap Se through which the compressed air G can pass is present between the outer peripheral surface of the bearing body 81*a* of the first radial bearing 81 and the bearing housing 72. A downstream outlet of the second communication flow passage 14 is connected or fluidly coupled to the first outer gap Se formed between the outer peripheral surface of the bearing body 81*a* and the bearing housing 72 so that the second communication flow passage 14 is in communication with or fluidly coupled to this first outer gap Se.

The motor housing 7 is provided with a third communication flow passage 15 that connects or fluidly couples the shaft space A to the turbine housing 22, and a fourth communication flow passage 16 that connects or fluidly couples the shaft space A to the turbine housing 22. An inlet of the third communication flow passage 15 is disposed closer to the compressor impeller 31 than an outlet of the second communication flow passage 14. An inlet of the fourth communication flow passage 16 is disposed closer to the turbine impeller 21 than an outlet of the second communication flow passage 14. Accordingly, the compressed air G reaching the shaft space A through the second communication flow passage 14 branches into a flow toward the third communication flow passage 15 and a flow toward the fourth communication flow passage 16.

A flow passage for the compressed air G flowing through the third communication flow passage 15 is a first branch flow passage (or "first cooling path") R1, and a flow passage for the compressed air G flowing through the fourth communication flow passage 16 is a second branch flow passage (or "second cooling path") R2. The first radial bearing 81 and the thrust bearing 83 are disposed on the first branch flow passage R1, and the second radial bearing 82 is disposed on the second branch flow passage R2. The compressed air G passing through the first branch flow passage R1 mainly cools the first radial bearing 81 and the thrust bearing 83. The compressed air G passing through the second branch flow passage R2 mainly cools the second radial bearing 82.

The third communication flow passage 15 forming the first branch flow passage R1 is connected or fluidly coupled to the thrust bearing 83. For example, a second outer gap Sf through which the compressed air G can pass is present between the outer peripheral surface of the bearing body 83*c* of the thrust bearing 83 and the bearing housing 72 and between the outer peripheral surface of the bearing body 83*c* and the diffuser plate 33. An upstream inlet of the third communication flow passage 15 is connected or fluidly coupled to the second outer gap Sf formed between the outer peripheral surface of the bearing body 83*c* and the bearing housing 72 so that the third communication flow passage 15 is in communication with or fluidly coupled to this second outer gap Sf.

The third communication flow passage 15 is provided to pass through the bearing housing 72 and the stator housing 71. A downstream outlet of the third communication flow passage 15 is connected or fluidly coupled to a fifth communication flow passage 17 provided in the turbine housing 22. A first orifice plate 41 for adjusting the flow rate of the compressed air G is provided between the third communication flow passage 15 and the fifth communication flow passage 17. An outlet of the fifth communication flow passage 17 is connected or fluidly coupled to the exhaust gas outlet 22*a* of the turbine housing 22.

That is, the first branch flow passage R1 is a flow passage for the compressed air G that passes through the first radial bearing 81 and the thrust bearing 83 from the outlet of the second communication flow passage 14 in the shaft space A and further passes through the third communication flow passage 15 and the fifth communication flow passage 17.

The fourth communication flow passage 16 forming the second branch flow passage R2 is connected or fluidly coupled to the second radial bearing 82. For example, the bearing body 82*a* of the second radial bearing 82 is fixed to the stator housing 71 via the flange 82*c*. The turbine housing 22 is fixed to the stator housing 71. A seal plate 23 provided with the labyrinth structure 23*a* is disposed between the stator housing 71 and the turbine housing 22. A space Sg through which the compressed air G can pass is formed between the flange 82*c* of the bearing body and the seal plate 23. An upstream inlet of the fourth communication flow passage 16 is connected or fluidly coupled to the space Sg formed between the flange 82*c* of the bearing body 82*a* and the seal plate 23 so that the fourth communication flow passage 16 is in communication with or fluidly coupled to this space Sg.

The fourth communication flow passage 16 is provided to pass through the seal plate 23 and the stator housing 71. A downstream outlet of the fourth communication flow passage 16 is connected or fluidly coupled to a sixth communication flow passage 18 provided in the turbine housing 22. A second orifice plate 42 for adjusting the flow rate of the compressed air G is provided between the fourth communication flow passage 16 and the sixth communication flow passage 18. An outlet of the sixth communication flow passage 18 is connected or fluidly coupled to the exhaust gas outlet 22*a* of the turbine housing 22.

In some examples, the second branch flow passage R2 is a flow passage for the compressed air G that passes through the second radial bearing 82 from the outlet of the second communication flow passage 14 in the shaft space A and further passes through the fourth communication flow passage 16 and the sixth communication flow passage 18.

Figure 3:
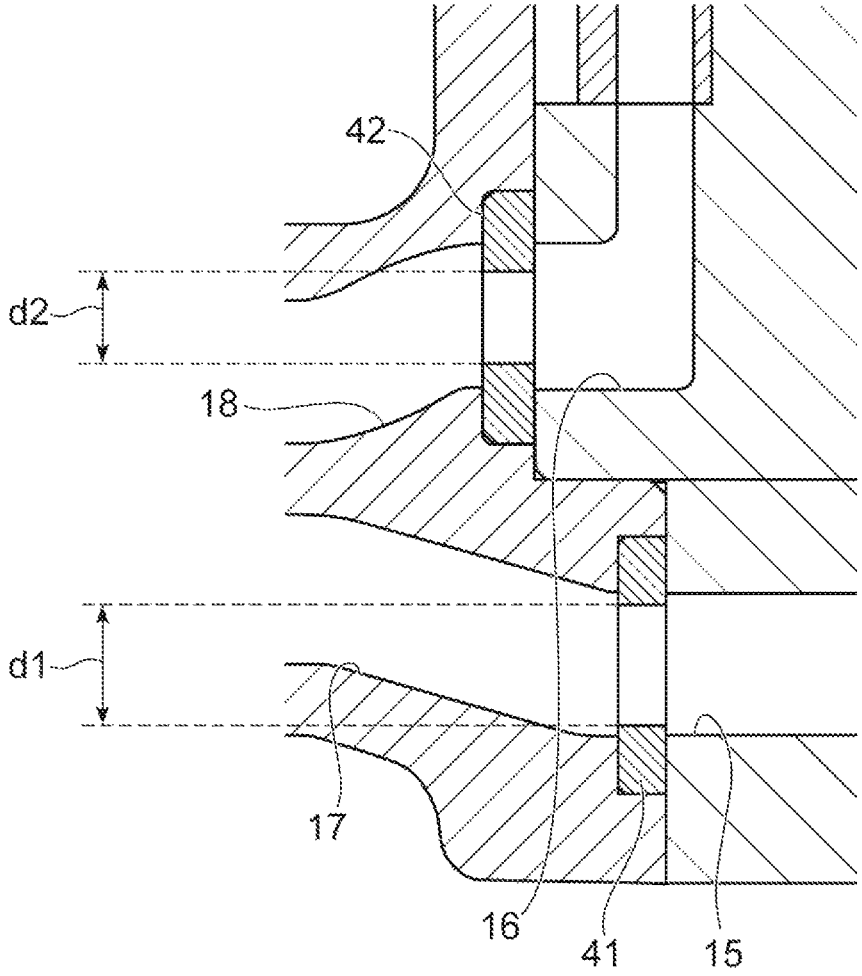
FIG. 3 is an enlarged cross-sectional view of an example orifice plate.

In some examples, the first orifice plate 41 and the second orifice plate 42 illustrated in FIGS. 2 and 3 may comprise or form a flow rate adjusting unit (flow rate adjusting device) that causes the flow passage cross-section of the second branch flow passage R2 to be smaller than the flow passage cross-section of the first branch flow passage R1. For example, the diameter d1 of an orifice (orifice diameter) of the first orifice plate 41 is set to be larger than the diameter d2 of an orifice (orifice diameter) of the second orifice plate 42. Accordingly, under comparable operating conditions, the resistance obtained while the compressed air G passes through the flow passage (first branch flow passage R1) for the compressed air G flowing through the third and fifth communication flow passage 15 and 17 is lower than that obtained while the compressed air G passes through the flow passage (second branch flow passage R2) for the compressed air G flowing through the fourth and sixth communication flow passages 16 and 18. Accordingly, the flow rate in the first branch flow passage R1 may be higher than the flow rate in the second branch flow passage R2. The first radial bearing 81 and the thrust bearing 83 are disposed on the first branch flow passage R1, and the second radial bearing 82 is disposed on the second branch flow passage R2. By making the flow rate in the first branch flow passage R1 higher than the flow rate in the second branch flow passage R2, one or both of the first radial bearing 81 and the thrust bearing 83 can be efficiently or selectively cooled.

In some examples, the centrifugal compressor 1 may include the gas bleed port 33*b* that is provided closer to the discharge port 32*b* than the compressor impeller 31 in the flow direction in the compressor housing 32. Additionally, the centrifugal compressor 1 may include the air-cooling line 11 that connects or fluidly couples the gas bleed port 33*b* to the air bearing structure 8, and the heat exchanger 9 that is disposed on the air-cooling line 11. In some examples, the heat exchanger 9 is mounted on at least one of the motor housing 7 and the compressor housing 32. Additionally, at least part of the compressed air G may be configured to flow through a position being in contact with the air bearing structure 8 and the gas bleed port 33*b*.

Figure 4:
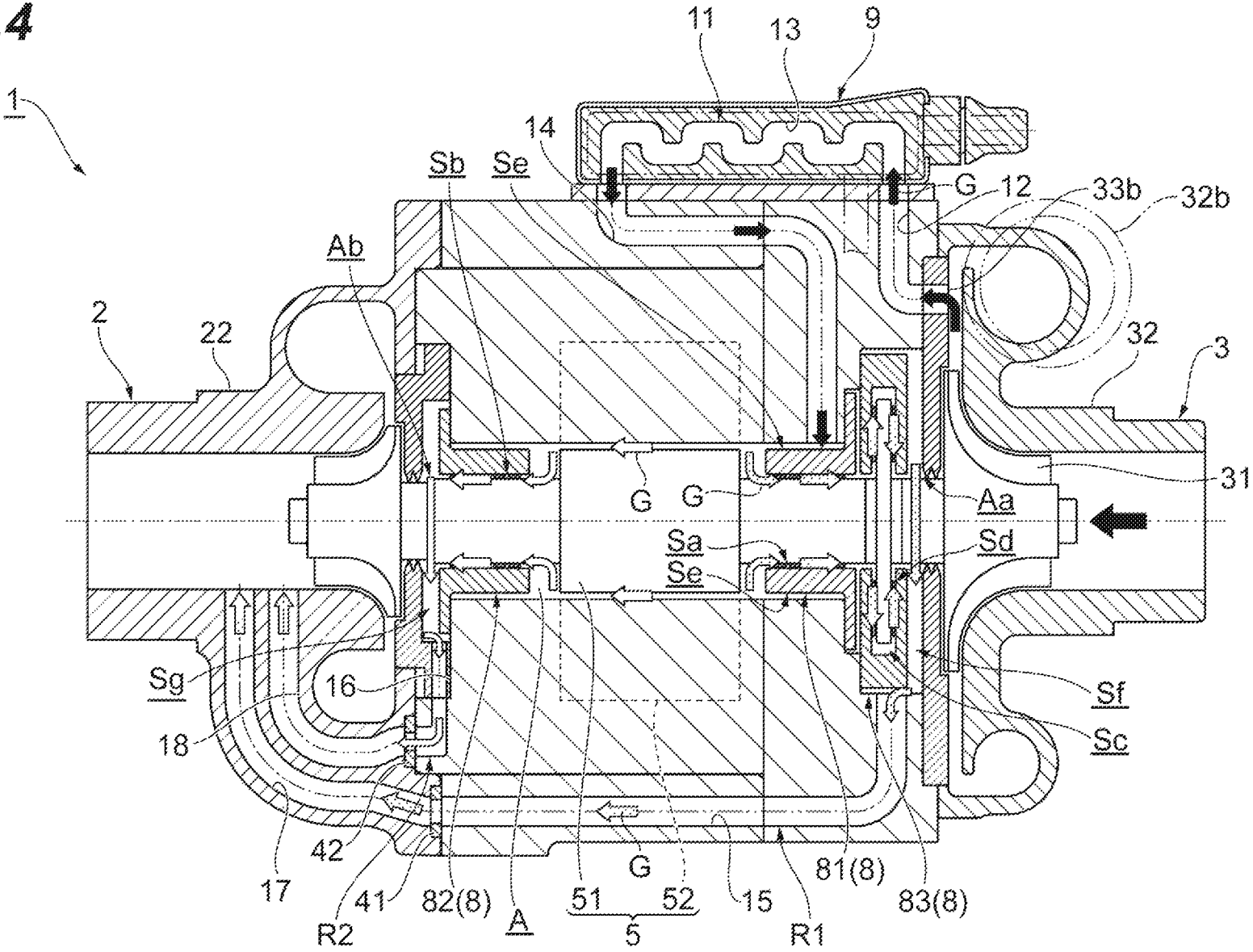
FIG. 4 is a diagram illustrating where the flow of compressed air is added to the orifice plate of FIG. 2.
Figure 5:
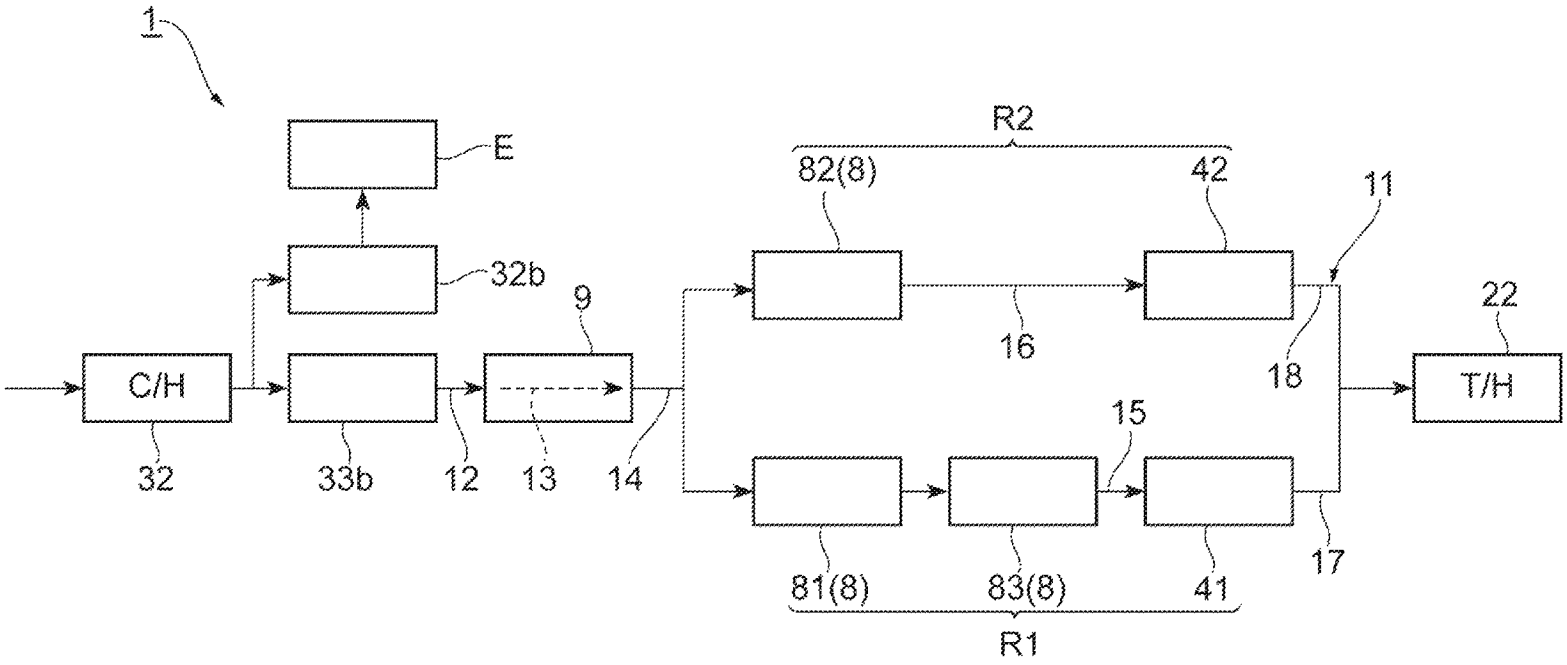
FIG. 5 is a diagram schematically illustrating an example flow of compressed air.

An example flow path of the compressed air G in the centrifugal compressor 1 will now be described in additional detail with reference to FIGS. 4 and 5.

The compressed air which is compressed in the compressor housing 32 by the compressor impeller 31, is discharged from the discharge port 32*b* and is supplied to the fuel cell system E. Further, a part of the compressed air G is extracted from the gas bleed port 33*b* that is the inlet of the air-cooling line 11, passes through the first communication flow passage 12, and is supplied to the heat exchanger 9. The compressed air which is cooled by the heat exchanger 9, passes through the second communication flow passage 14 and is supplied to the shaft space A. Here, the compressed air G is divided in two directions, a part of the compressed air G passes through the first branch flow passage R1, and the other part thereof passes through the second branch flow passage R2.

The compressed air G passing through the first branch flow passage R1 passes through the first radial bearing 81 and the thrust bearing 83, which are the air bearing structure 8, then passes through the first orifice plate 41, and is discharged to the turbine housing 22.

The compressed air G passing through the second branch flow passage R2 passes through the second radial bearing 82, which is the air bearing structure 8, then passes through the second orifice plate 42, and is discharged to the turbine housing 22.

In some examples, a part of the compressed air G compressed by the compressor impeller 31 passes through the gas bleed port 33*b* and is supplied to the air-cooling line 11. The heat exchanger 9 is disposed on the air-cooling line 11 through which the compressed air G passes, and the compressed air G cooled by the heat exchanger 9 is supplied to the air bearing structure 8 and cools the air bearing structure 8. In the centrifugal compressor 1, the compressed air G is used as a refrigerant that independently cools the air bearing structure 8. The heat exchanger 9, which cools the compressed air G, is mounted on at least one of the motor housing 7 and the compressor housing 32. Accordingly, since a cooling path when the compressed air G cooled by the heat exchanger 9 is supplied to the air bearing structure 8 can be made shorter as compared to a case where the heat exchanger 9 is installed at another place outside the electric supercharger, a heat loss can be suppressed. Further, since the compressed air G is gas, the compatibility of the compressed air G with the air bearing structure 8 is also better than that of a liquid refrigerant, such as the coolant C. Therefore, the compressed air G may be used to cool the air bearing structure 8 using a compact internal structure that allows the overall size of the electric supercharger to be reduced.

In some examples, the heat exchanger 9 includes the air flow passage 13 through which the compressed air G passing through the air-cooling line 11 passes, and the refrigerant line 10 through which the coolant C of which the temperature is lower than the temperature of the compressed air G passes. The air flow passage 13 includes the inlet 13*a* and the outlet 13*b* for the compressed air G, and the inlet 13*a* is disposed closer to the compressor impeller 31 than the outlet 13*b* in a direction along the rotary shaft 4. Since the inlet 13*a* of the air flow passage 13 is disposed close to the compressor impeller 31, a cooling path along which the compressed air G is introduced into the heat exchanger 9 can be made shorter, and the size of the electric supercharger may be reduced.

In some examples, the air bearing structure 8 includes the thrust bearing 83 and the first and second radial bearings 81 and 82. Additionally, the air-cooling line 11 includes the first branch flow passage R1 that passes through and cools at least the thrust bearing 83, and the second branch flow passage R2 that passes through and cools the second radial bearing 82 without passing through the thrust bearing 83. By separating the first branch flow passage R1 and the second branch flow passage R2, the thrust bearing 83 and the first and second radial bearings 81 and 82 may be efficiently or selectively cooled.

In some examples, the flow rate adjusting unit (the first and second orifice plates 41 and 42) may be provided to the downstream side relative to the air bearing structure 8. Additionally, the flow passage cross-section of the first branch flow passage R1 may be made larger than the flow passage cross-section of the second branch flow passage R2 by the flow rate adjusting unit. Accordingly, since the flow rate of the compressed air G, which is cooled by the heat exchanger 9, passing through the first branch flow passage R1 is likely to be higher than the flow rate of the compressed air G passing through the second branch flow passage R2, the thrust bearing 83 may be efficiently or selectively cooled. In some examples, the flow rate adjusting unit may be provided to the upstream side relative to the air bearing structure 8. In other examples, the flow rate adjusting unit may be provided to both the upstream side and the downstream side relative to the air bearing structure 8.

In some examples, the first orifice plate 41 is disposed on the downstream side relative to the air bearing structure 8 (thrust bearing 83) on the first branch flow passage R1, and the second orifice plate 42 is disposed on the downstream side relative to the air bearing structure 8 (second radial bearing 82) on the second branch flow passage R2. Additionally, the orifice diameter d2 of the second orifice plate 42 may be smaller than the orifice diameter d1 of the first orifice plate 41. Accordingly, the flow rate of the compressed air G passing through the first branch flow passage R1 may be higher than the flow rate of the compressed air G passing through the second branch flow passage R2 in order to efficiently or selectively cool the thrust bearing 83.

It is to be understood that not all aspects, advantages and features described herein may necessarily be achieved by, or included in, any one particular example embodiment. Indeed, having described and illustrated various examples herein, it should be apparent that other examples may be modified in arrangement and detail. We claim all modifications and variations coming within the spirit and scope of the subject matter claimed herein.

For example, the first orifice plate and the second orifice plate may collectively be understood to form the flow rate adjusting unit. However, in some examples the cross-sectional area of the middle portion of the flow passage may be increased or reduced.

In still other examples, a valve or the like may be provided on the flow passage. Further, although the dynamic pressure air bearings may collectively be understood to form the gas bearing structure, in some examples static pressure air bearings may be used instead of the dynamic pressure bearings.

Furthermore, the air-cooling line may include a branch in the middle thereof to form the first and second cooling paths. However, in other examples, two gas bleed ports may be provided and the first cooling path and the second cooling path may be completely separated from each other to form two cooling paths that are fluidly coupled to the two gas bleed ports, respectively.

Moreover, in some examples the centrifugal compressor may comprise an electric supercharger which does not include a turbine.

We claim:

1. A centrifugal compressor comprising:

a rotary shaft of a compressor impeller;

a gas bearing structure that supports the rotary shaft, wherein the gas bearing structure includes a thrust bearing and a radial bearing;

a motor that rotates the rotary shaft;

a motor housing that houses the motor;

a compressor housing that houses the compressor impeller and includes a discharge port configured to discharge compressed gas;

a gas bleed port fluidly coupled to the discharge port in the compressor housing;

a bearing cooling line that fluidly couples the gas bleed port to the gas bearing structure, wherein the bearing cooling line includes a first cooling path that passes through the thrust bearing, and a second cooling path that passes through the radial bearing, wherein an outlet of the first cooling path and an outlet of the second cooling path are formed at the motor housing, and wherein a cross-sectional flow area at the outlet of the second cooling path is smaller than a cross-sectional flow area at the outlet of the first cooling path; and a heat exchanger including a gas flow passage that forms a portion of the bearing cooling line, wherein the heat exchanger is mounted on at least one of the motor housing and the compressor housing, and wherein the heat exchanger is configured to remove heat from the compressed gas that passes through the gas flow passage.

2. The centrifugal compressor according to claim 1, wherein the heat exchanger further includes a refrigerant flow passage configured to contain a refrigerant that is maintained at a lower temperature than the compressed gas contained in the gas flow passage, wherein the gas flow passage includes an inlet and an outlet for the compressed gas, and wherein a distance between the inlet and the compressor impeller is less than a distance between the outlet and the compressor impeller, in a direction along the rotary shaft.

3. The centrifugal compressor according to claim 1, wherein the thrust bearing is located on an opposite side of the motor from the radial bearing, and wherein the second cooling path passes through the radial bearing without passing through the thrust bearing.

4. The centrifugal compressor according to claim 3, wherein the gas bearing structure includes a second radial bearing located between the motor and the thrust bearing along an axial direction of the rotary shaft, and wherein the first cooling path passes through both the thrust bearing and the second radial bearing.

5. The centrifugal compressor according to claim 1, wherein a first end of the motor housing is located adjacent the compressor housing, and wherein the outlet of the first cooling path and the outlet of the second cooling path are located at a second end of the motor housing that is opposite the first end of the motor housing along an axial direction of the rotary shaft.

6. The centrifugal compressor according to claim 1, further comprising a first orifice that is located at the outlet of the first cooling path and a second orifice that is located at the outlet of the second cooling path, wherein an orifice diameter of the first orifice is larger than an orifice diameter of the second orifice.

7. A centrifugal compressor comprising:

a rotary shaft of a compressor impeller;

a motor that rotates the rotary shaft;

a motor housing that houses the motor;

a gas bearing structure that supports the rotary shaft, wherein the gas bearing structure includes a thrust bearing and a radial bearing, and wherein the thrust bearing is located on an opposite side of the motor from the radial bearing;

a compressor housing that houses the compressor impeller and includes a discharge port configured to discharge compressed gas;

a gas bleed port fluidly coupled to the discharge port in the compressor housing; and a bearing cooling line that fluidly couples the gas bleed port to the gas bearing structure, wherein the bearing cooling line includes a first cooling path and a second cooling path that are fluidly coupled to a shaft space within the motor housing which at least partially surrounds the rotary shaft, wherein the first cooling path passes through the thrust bearing and through a first end portion of the shaft space which surrounds the rotary shaft at a first end of the motor housing that is adjacent the compressor housing, wherein the second cooling path passes through the radial bearing and through a second end portion of the shaft space which surrounds the rotary shaft at a second end of the motor housing that is opposite the first end of the motor housing along an axial direction of the rotary shaft, and wherein an outlet of each of the first cooling path and the second cooling path is located at the second end of the motor housing.

8. The centrifugal compressor according to claim 7, further comprising a turbine housing, wherein both the first cooling path and the second cooling path fluidly couple the turbine housing to the shaft space, and wherein the second end of the motor housing is adjacent the turbine housing.

9. The centrifugal compressor according to claim 7, wherein the motor housing comprises a bearing housing that houses the thrust bearing, wherein the thrust bearing comprises a thrust collar fixed to the rotary shaft, and an annular bearing body fixed to the bearing housing, wherein the first cooling path passes through a gap formed between the thrust collar and the annular bearing body, and wherein the second cooling path passes through the radial bearing without passing through the thrust bearing.

10. A centrifugal compressor comprising:

a rotary shaft of a compressor impeller;

a gas bearing structure that supports the rotary shaft;

a bearing housing that houses the gas bearing structure;

a motor that rotates the rotary shaft;

a motor housing that houses the motor, wherein the motor housing comprising a stator housing that houses a stator of the motor;

a compressor housing that at least partially houses the compressor impeller;

a bearing cooling line configured to supply compressed gas from the compressor impeller to the gas bearing structure; and a heat exchanger including a gas flow passage that forms a portion of the bearing cooling line, wherein an inlet of the gas flow passage is connected to the bearing housing, wherein an outlet of the gas flow passage is connected to the stator housing, wherein the heat exchanger is mounted on at least one of the motor housing and the compressor housing, and wherein the heat exchanger is configured to remove heat from the compressed gas that passes through the gas flow passage.

11. The centrifugal compressor according to claim 10, wherein the heat exchanger is mounted on the motor housing so as to extend across the stator housing and the bearing housing along an axial direction of the rotary shaft.

12. The centrifugal compressor according to claim 10, wherein the gas bearing structure includes a thrust bearing and a radial bearing, and wherein the bearing cooling line includes a first cooling path that passes through the thrust bearing, and a second cooling path that passes through the radial bearing.

13. The centrifugal compressor according to claim 12, wherein the thrust bearing is located on an opposite side of the motor from the radial bearing, and wherein the second cooling path passes through the radial bearing without passing through the thrust bearing.

14. The centrifugal compressor according to claim 12, wherein the thrust bearing comprises a thrust collar fixed to the rotary shaft, and an annular bearing body fixed to the bearing housing, and wherein the first cooling path passes through a gap formed between the thrust collar and the annular bearing body.

15. A centrifugal compressor comprising:

a rotary shaft of a compressor impeller;

a turbine including a turbine impeller configured to rotate the rotary shaft;

a turbine housing that houses the turbine impeller;

a gas bearing structure that supports the rotary shaft;

a motor that rotates the rotary shaft;

a motor housing that houses the motor;

a compressor housing that at least partially houses the compressor impeller; and a bearing cooling line configured to supply compressed gas from the compressor impeller to the gas bearing structure, wherein the bearing cooling line includes a first cooling path and a second cooling path that are fluidly coupled to a shaft space within the motor housing which at least partially surrounds the rotary shaft, wherein the first cooling path passes through a first end portion of the shaft space which surrounds the rotary shaft at a first end of the motor housing that is adjacent the compressor housing, wherein the second cooling path passes through a second end portion of the shaft space which surrounds the rotary shaft at a second end of the motor housing that is opposite the first end of the motor housing along an axial direction of the rotary shaft, wherein an outlet of each of the first cooling path and the second cooling path is located at the second end of the motor housing that is adjacent the turbine housing, and wherein both the first cooling path and the second cooling path fluidly couple the turbine housing to the shaft space.

16. The centrifugal compressor according to claim 15, wherein the first cooling path and the second cooling path fluidly couple the turbine housing to the gas bearing structure.

17. The centrifugal compressor according to claim 16, wherein a second cross-sectional flow area at the outlet of the second cooling path is smaller than a first cross-sectional flow area at the outlet of the first cooling path so as to reduce a flow rate of the compressed gas through the second cooling path as compared to the first cooling path.

18. The centrifugal compressor according to claim 17, further comprising an orifice located in the second cooling path and having the second cross-sectional flow area.

19. The centrifugal compressor according to claim 16, wherein the gas bearing structure comprises a radial bearing and a thrust bearing that is disposed between the radial bearing and the compressor impeller along the axial direction of the rotary shaft, wherein the motor housing comprises a bearing housing that houses the thrust bearing and the radial bearing, wherein the thrust bearing comprises a thrust collar fixed to the rotary shaft, and an annular bearing body fixed to the bearing housing, and wherein the first cooling path passes through a gap formed between the thrust collar and the annular bearing body.

20. The centrifugal compressor according to claim 19, wherein the motor housing comprising a stator housing that houses a stator of the motor, wherein the gas bearing structure includes a second radial bearing located in the stator housing, and wherein the second cooling path passes through the second radial bearing without passing through the gap formed between the thrust collar and the annular bearing body, and without passing through the radial bearing located in the bearing housing.

* * * * *